United States Patent [19]

Corsette

[11] 4,387,819

[45] Jun. 14, 1983

[54] SEALING MEANS FOR A SNAP-ON FITMENT

[76] Inventor: Douglas F. Corsette, 6559 Firebrand St., Los Angeles, Calif. 90045

[21] Appl. No.: 333,749

[22] Filed: Dec. 23, 1981

[51] Int. Cl.[3] ..... B65D 47/14

[52] U.S. Cl. ..... 215/273; 222/546; 222/569; 215/344

[58] Field of Search ..... 222/569, 546; 215/320, 215/273, 344

[56] References Cited

U.S. PATENT DOCUMENTS

| | | | |
|---|---|---|---|
| Re. 29,850 | 11/1978 | Labarre | 215/295 X |
| 2,670,885 | 3/1954 | Allen | 222/569 |
| 3,099,361 | 7/1963 | Ruetz . | |
| 3,343,700 | 9/1967 | Heubl | 215/344 X |
| 3,860,152 | 1/1975 | Marti | 215/295 X |
| 3,888,373 | 6/1975 | Gach et al. | 215/341 X |
| 4,171,749 | 10/1979 | Obrist et al. | 222/546 X |

*Primary Examiner*—Donald F. Norton

*Attorney, Agent, or Firm*—Watson, Cole, Grindle & Watson

[57] ABSTRACT

A sealing element for a snap-on fitment has spaced apart inner and outer skirts engageable with opposite sides of the container neck, an annular wall interconnecting the skirts and an extension from the annular wall forming a fitment engaging portion. An annular snap bead extends from the connecting annular wall to facilitate snap engagement with the fitment, and the engaging portion has an inner sealing surface and a seal bead adjacent its outer end. The connecting wall has an annular relieved section opening into the space between the skirts so that any distortions imposed upon the snap bead and upon the sealing surface as occasioned by any dimensional and/or shape irregularities in the container neck are reduced by the relief provided between inner and outer engagements with the container neck. This results in an isolation of any distortions of the skirts relative to one another, an isolation of any outer skirt distortion relative to the snap bead, an isolation of any inner skirt distortion relative to the sealing surface, and the maintenance of dimensional stability between the snap bead and the sealing surface.

9 Claims, 8 Drawing Figures

FIG. 1
(PRIOR ART)
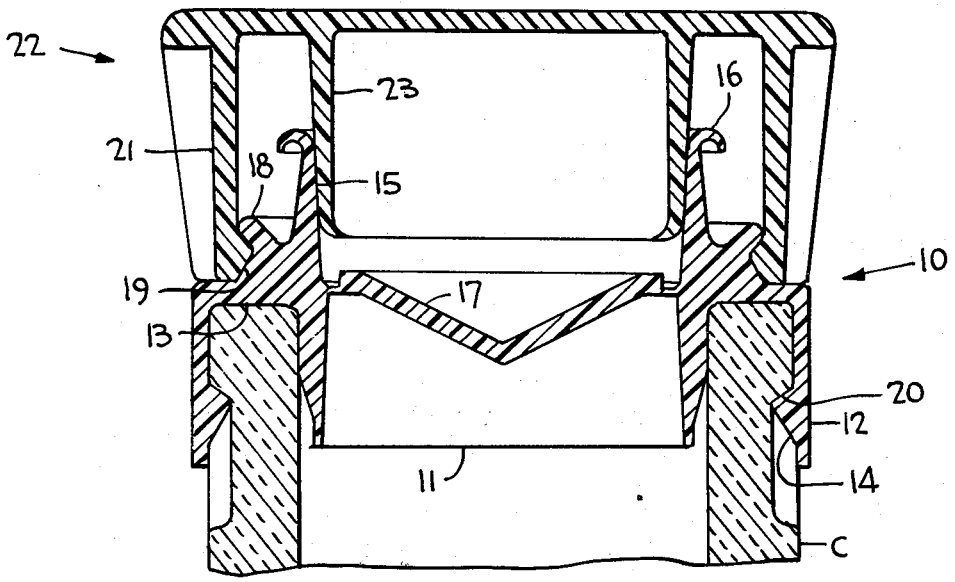
FIG. 2
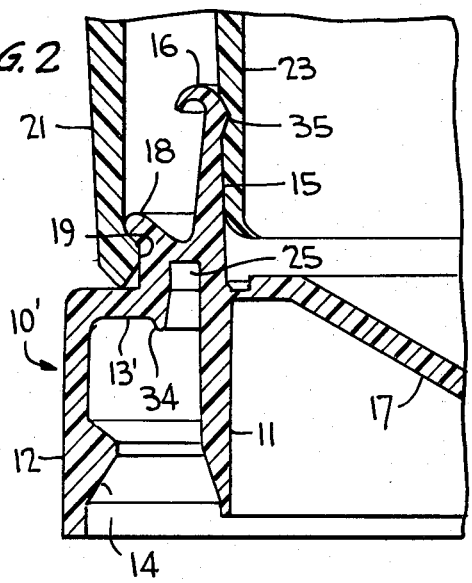
FIG. 4
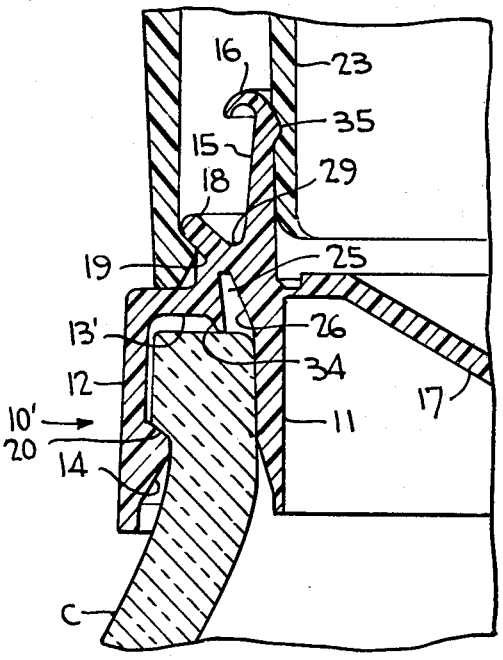
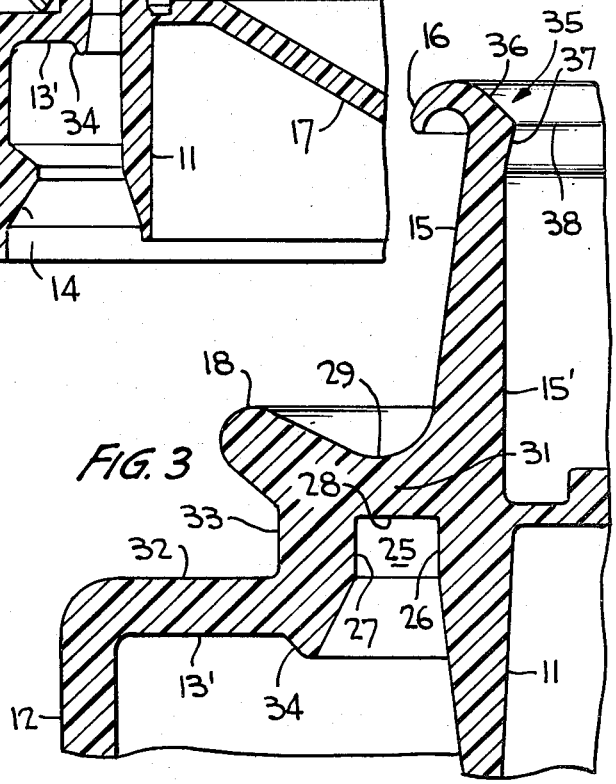
FIG. 3

SEALING MEANS FOR A SNAP-ON FITMENT

BACKGROUND OF THE INVENTION

This invention relates generally to a sealing element fitted on the neck of a liquid container to which a closure member or a dispensing element is secured, and more particularly to such a sealing element which isolates the closure member or dispensing element from the attachment means of the sealing element.

U.S. Pat. No. Re. 29,850 to Labaree discloses a sealing element of the general type involved herein as being fitted on a bottle neck and having a removable overcap engageable therewith. The sealing element is in the form of a closure having a sealing and tamperproof diaphragm extending across the mouth of the bottle which is capable of being torn open to facilitate pouring of the liquid product from the bottle. Experience has shown that leakages will occur between the closure and the bottle and after removing the sealing diaphragm between the overcap and the closure especially as the result of dimensional and/or shape irregularities in the bottle neck which impose distortions on the snap bead for the overcap and upon the interface on the reseal elements between the closure and the overcap. Thus, with tight fitting bottle finishes, the skirts engaging the inner and outer walls of the bottle neck are apt to distort causing leakage between the bottle and the closure, and these distortions have a tendency to shift the pouring spout out-of-round or to otherwise distort thereby causing leakages between the reseal surfaces of the closure and the overcap. The snap bead is also likely to become distorted so as to affect the reseal engagement between the reseal surfaces when the overcap is snap-fitted in place. It should be pointed out that the bottle irregularities referred to here include, without limitation, aberrations in the outer diameter and /or inner diameter of the bottle neck, an out-of-round contour of the mouth of the bottle, non-concentric outer diameter and inner diameter walls of the bottle neck, height of retention bead, etc. Such bottle finish irregularities frequently occur during the molding of glass or plastic bottles.

SUMMARY OF THE INVENTION

It is therefore an object of the present invention to improve upon the Labarre-type sealing element, in a simple and economical, yet highly efficient manner, so as to avoid the leakage problems known to prevail between the sealing element and the bottle finish and between the sealing element and a fitment engaged therewith.

In keeping with this overall objective, the sealing element according to the invention makes provision for a relief between inner and outer engagements with the bottle finish to thereby reduce any distortion of the snap bead for fitment and the interface of the reseal parts from tight fitting bottle finishes. This relief is imparted to the sealing element by the formation of an annular relieved section located in the wall interconnecting the skirts and opening into the space between the skirts adjacent the inner skirt. Distortions of the bottle engaging skirts may thus be isolated from one another, outer skirt distortions are isolated from the snap bead, inner skirt distortions are isolated from the pour lip seal, and the dimensional stability between the snap bead and the fitment seal seat is maintained for different bottle dimensions within normal bottle ranges. The seals are thus improved and may be further enhanced by the provision of an annular seal bead(s) located on the interconnecting wall of the skirts and extending into the space therebetween, as well as an annular seal bead on a fitment engaging portion of the sealing element. This latter seal bead may have its outer surface blending with the curvature of this portion which forms a pour lip when the fitment engageable therewith forms an overcap, the inner surface of the seal bead being conical so that the junction between surfaces defines an annular mouth edge which renders the spout dripless. Also, this junction functions to better penetrate the reseal surface of the fitment which plugs into engaging portion.

Other objects, advantages and novel features of the invention will become more apparent from the following detailed description of the invention when taken in conjunction with the accompanying drawings.

BRIEF DESCRIPTION OF THE DRAWINGS

FIG. 1 is a vertical sectional view of the sealing element, with a fitment in the form of an overcap snap-fitted in place, in accordance with the prior art;

FIG. 2 is a view similar to FIG. 1 showing a part of the sealing element according to the invention;

FIG. 3 is an enlarged detail view, in section, of a part of the FIG. 2 sealing element; and FIGS. 4, 5, 6, 7 and 8 are views similar to FIG. 2 showing various embodiments of the present invention.

DETAILED DESCRIPTION OF THE INVENTION

Figure 5:
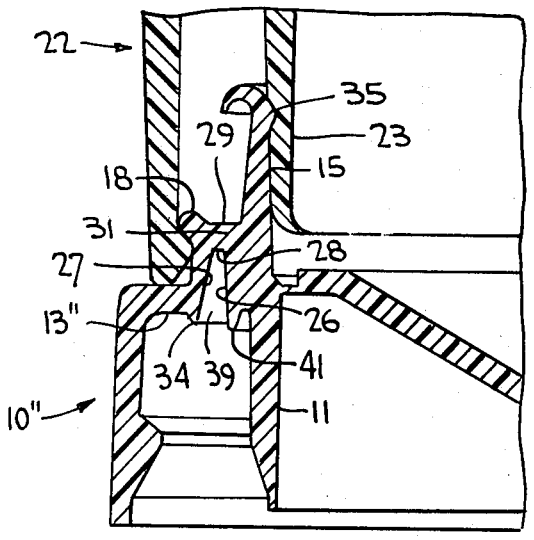

Turning now to the drawings wherein like reference characters refer to like and corresponding parts throughout the several views, a sealing element in the form of a pouring closure is generally designated 10 in FIG. 1 and, as in the aforementioned Labarre patent, may be made by injection molding of a synthetic plastic material such as polyethylene. This prior art closure has spaced inner and outer cylindrical skirts 11 and 12 respectively in engagement with the inner and outer walls of the neck of the container C, and an annular wall 13 interconnecting the skirts and overlying the upper terminal end of the container neck. The outer skirt may have an inwardly extending lock ring 14 seated in an external groove or seated below an annular retention bead 20 surrounding the neck of the bottle or container. The closure is assembled on the container neck by forcing it down thereon. And, an annular skirt 15 concentric with the inner skirt is extended above wall 13 to form a tubular fitment engaging portion in the form of a pouring spout having an outwardly curved annular lip 16. At a point suitably below the upper end of the pour spout, the closure is provided with a water-tight transverse membrane 17 which is made frangible for tearing it away by pulling upwardly on a ring or the like (not shown) attached thereto. The prior art closure is further provided with an annular snap bead 18 which extends outwardly of wall 13 to facilitate a snap fit with an annular rim 19 provided at the terminal end of an outer wall 21 of a fitment in the form of a removable overcap 22. This overcap is typically used for re-covering the spout after membrane 17 is initially torn away. A depending inner annular wall 23 of the overcap is designed as a plug for insertion into the pour spout for engagement with the inner surface thereof forming a sealing surface.

A sealing element 10', shown in FIG. 2, may be utilized as a pouring closure for an overcap fitment as in FIG. 1, or as a sealing means for a dispenser fitment, without departing from the invention. The same features of the sealing element and fitment as found in FIG. 1 will be similarly identified, and those which are not the same will be identified by an additional prime (′). Thus, recognizing the need for improving upon the fluid tight engagement between the sealing element and the bottle, and between the fitment engaging portion and the fitment, the modifications of the sealing element and the consequent improvements made to seal against leakages will now be described.

Connecting wall 13′, which overlies and is at least slightly spaced above the upper terminal end of the container neck (is typically shown in FIG. 4), is formed as having an annular, cup-shaped relieved section 25 therein adjacent inner skirt 11 and opening into the space between skirts 11 and 12. This relieved section has opposed side wall 26, 27 and a bottom wall 28, all as more clearly seen in FIG. 3. In the FIG. 2 embodiment, side wall 26 is formed as a smooth extension of the outer surface of inner skirt 11, and bottom wall 28 extends radially outwardly from the root portion of the sealing element. In FIG. 4 side wall 26 diverges outwardly relative to the outer surface of skirt 11. An outer surface 29 of wall 13′ confronts bottom wall 28 and forms therewith a first annular wall section 31 in spaced relation to a second wall section 32 of wall section 13′ which extends radially inwardly of outer skirt 12. The first and second wall sections are interconnected by a third wall section 33, and snap bead 18 extends outwardly of essentially the juncture between wall sections 31 and 33.

The extent of opposed side wall 26 and 27 are such as to form relieved section 25 as having a predetermined depth to provide isolation of the functional elements of the sealing element. A relief is thus formed between inner and outer engagements with the container neck for the intended purpose of reducing the distortion of the snap bead for the fitment and for reducing the distortion at the interface of elements 15, 23 from tight fitting bottle finishes. It has been found that these distortions are imposed on the snap bead and on the interface of elements 15, 23 as occasioned by dimensional and/or shape irregularities of the container neck. Such irregularities may, for example, include an out-of-round bottle neck, non-concentric inner and outer bottle neck diameters, aberrations in the outer diameter and/or inner diameter of the bottle neck, etc. These distortions have a tendency to affect the concentricity of fitment engaging portion 15 relative to wall 23 of the fitment, the circularity of the portion 15, etc., which can be seen to impair the sealability between portion 15 and wall 23 of the fitment which may cause leakages. Also, these distortions affect snap bead 18 in the same manner so that any weakening in the snap fit between the fitment and portion 15 could likewise impair the sealability between these members at the interface thereof. Therefore, by providing relief between the inner and outer skirts which engage opposed surfaces of an irregularly shaped and/or dimensioned container neck, the aforementioned distortions may be positively reduced. Relieved section 25 has a four-fold effect on the functional elements of sealing element 10′ as, for example, isolation from one another of the skirt engagements with the bottle finish, isolation of any outer skirt distortion relative to the snap bead, isolation of any inner skirt distortion relative to the 15, 23 interface, and the maintenance of dimensional stability between the snap bead and the 15, 23 interface.

An annular seal bead 34 (FIGS. 2 and 3) extends from the inner end of third wall section 33 into the space between the inner and outer skirts to improve sealing on the top of bottle or container C finishes. This seal bead remains substantially undisturbed by the bottle irregularities discussed above because of the relief provided between the inner and outer skirts as they engage opposed surfaces of the container neck. Seal bead 34 is thus not apt to shift laterally since the distortions due to bottle finish irregularities imposed thereon are likewise reduced.

As seen most clearly in FIG. 3, an annular seal bead 35 is disposed on the inner surface of fitment engaging portion 15 near its outer extremity to get as far away as possible from distortions caused by bottle irregularities and to use an area of greatest conformity of portion 15 to the plug 23 seal of the fitment. Seal bead 35 is located just below the outer end of portion 15 such that the upper curved surface 26 of the seal bead will blend with the contour of pour lip 16 without obstructing insertion of plug 23. Lower surface 37 of the seal bead is conical so as to define an annular mouth edge 38 at the junction between surfaces 36 and 37. This mouth edge penetrates into the outer surface of wall 23 when the overcap is snapped into place. Further, this mouth edge permits the pour spout to function as a dripless pour lip by directing the drips back into the bottle after the pouring ceases upon an uprighting of the bottle.

Because of substantial variations in the dimension from the top extremity of the container to the underside of annular retention bead 20 on the outside wall of the container neck, the fit of usual snap-on fitments can cause bulging of wall 12 due to failure of the upper surface of lock ring 14 to snap fully beneath bead 20. A further problem is a loose fitting snap bead which fails to compress the sealing element which may be provided on the top extremity of the container. To avoid these problems, the present invention does not compress annular wall 13′ against the top extremity of the container neck but relies on annular seal bead 34 to conform to the top of the container to effect a liquid-tight seal while annular wall 13′ can flex slightly to permit lock ring 14 to be fully seated below annular retention bead 20 on the outside of the bottle neck. Thus there is sufficient resiliency in seal 34 and in annular wall 13′ accommodate normal dimensional tolerances in container retention bead 20 and the usual condition of the sealing surface on the top extremity of the container neck. Annular wall 13′ will be so dimensioned to withstand the strain of forcing lock ring 14 around and under container retention bead 20 and to maintain sealing compression of seal bead 34 against the mating surface on the top of the container neck.

The present invention likewise effects a secure attachment of a dispensing element to a container in a snap-on type of fitment without inducing unsightly bulges in the outer surface of skirt 12. Conventionally, most snap-on closures rely on a tight fit of the inside surface of skirt 12 against the outside surface of the retention bead of the container. The seals thus accomplished are unreliable or exhibit failure due to the dimensional variations, surface aberrations, and the important fact that most containers have a mold parting line crossing the intended seal surface, making at least a minute line of demarcation transverse to the sealing area and forming at least a capillary leakage path. In practical experience, this mold parting line is generally sufficiently prominent to make sealing at that point quite questionable and unpredictable. In the present invention, no seal is attempted in the aforementioned area.

Sealing element 10' in FIGS. 2 and 4 are essentially the same except for the configuration of the annular relief section 25. And, the sealing element is shown in FIG. 4 relative to the neck of container C, this relationship being applicable for each of the disclosed embodiments of the invention. Thus, the inner surface of skirt 12 is spaced radially outwardly from the outer diameter of container retention bead 20 so that normal container dimensional tolerances can be accommodated without skirt 12 being bulged out of shape by encasement with the outer diameter of this container retention bead. It is further observed that the sealing engagement is not defeated by loose fitting diameters, parting lines, out of roundness, etc. The most controllable dimension on both glass and plastic containers having a neck designed to receive a fitment is the vertical dimension on the outside of the neck wall nearest the top extremity of the container. The present invention recognizes the above capabilities and limitations in container manufacture as well as plastic fitment by utilizing the above vertical dimension to achieve sealing engagement with minimum distortion by engaging the top surface of lock ring 14 under the controlled lower surface of container retention bead 20 to hold seal bead 34 against the top facing surface of the container without permitting annular wall 13' to inhibit proper engagement of lock ring 14 beneath the container retention bead or without relieving the compression of seal bead 34 by contact between annular wall 13' and the top of the container.

Sealing element 10'' is shown in FIG. 5 and is the same in all respects as element 10' except that a relieved section 39 provided in connecting wall 13'' is deeper than relieved section 25 so as to provide even more isolation of the distortions occasioned by bottle irregularities from the fitment retention bead 18 and the plug seal. Wall 26 of the relieved section lies substantially parallel to the outer surface of skirt 11 and likewise forms an extension thereof. And, outer surface 29 of first wall section 21 may function as a flange reinforcement for retaining the circularity of fitment engaging portion 15 at the seal interface with the fitment regardless of any irregularities of the container neck. This circular flange likewise reinforces the snap bead 18 so that integrity of the snap fit is maintained relative to the sealability of the fitment with portion 15. And, in this FIG. 5 embodiment, another annular seal bead 41 extends into the space between the skirts, this seal bead extending from the inner skirt and conforming individually to particular bottle finish surfaces. And, this seal bead 41 will remain isolated from outer diameter bottle finish aberrations of the container neck because of the relief provided between inner and outer engagements with the bottle finish.

Figure 6:
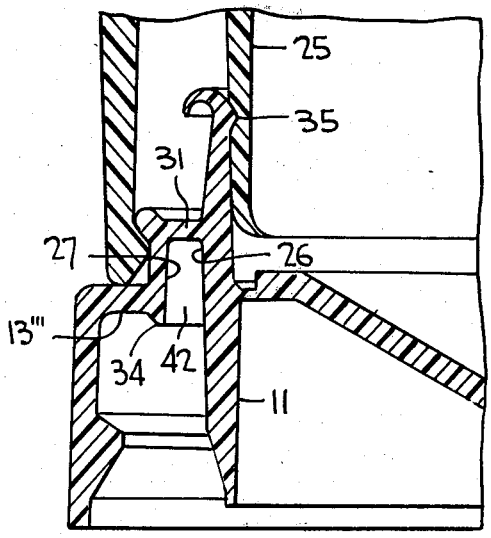

FIG. 6 is similar to FIG. 2 in that relieved section 42 has its side wall 26 formed as a smooth extension of the outer surface of inner skirt 11. Section 42, however, has an increased depth as compared to relieved section 25 so as to provide increased isolation of the functional elements of the sealing similarly as described with reference to FIG. 5. A single annular seal bead 34 is provided in this embodiment, and first wall section 21 functions similarly as described in FIG. 5 to reinforce the snap bead as well as to maintain the circularity of portion 15 at the interface with wall 23 of the fitment.

Figure 7:
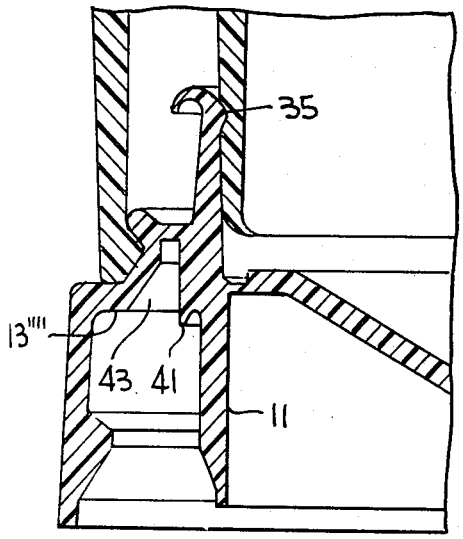

Connecting wall 13'''' of FIG. 7 embodiment has an annular relieved section 43 similar to section 42 of FIG. 6 in as much as added relief is provided between the inner and outer skirts. An annular seal bead 41 extends into the space between the skirts and is located on inner skirt 11. This seal location tends to isolate the external aberrations of bottle fits from the seal as molded.

Figure 8:
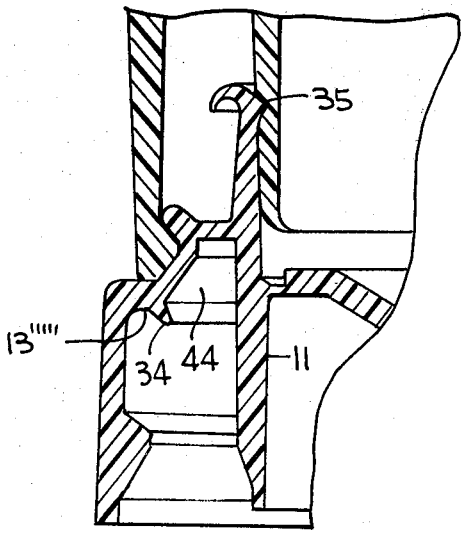

And, the FIG. 8 embodiment is similar to FIG. 6 in that connecting wall 13''''' has a relieved section 44 similarly formed as relieved section 42 except that seal bead 34 extends angularly into the space between the inner and outer skirts as a variant provided for the seal between the sealing element and the top edge of the bottle finish.

Annular seal bead 35, similar to that described with reference to FIG. 3, is provided for each of the FIGS. 4 to 8 embodiments. And, annular seal bead 34 and/or 41 functions as the primary seal engageable with the top extremity of the container finish.

Obviously, many other modifications and variations of the present invention are made possible in the light of the above teachings. It is therefore to be understood that within the scope of the appended claims, the invention may be practiced otherwise than as specifically described.

What is claimed is:

1. Sealing means for a snap-on fitment, comprising a body member having spaced apart inner and outer skirts engageable with opposite sides of the neck of a container, an annular wall interconnecting said skirts and overlying a terminal end of the container neck, an extension provided on said annular wall forming a tubular engaging portion and having an inner sealing surface, and an outwardly extending annular snap bead on said wall to facilitate a snap fit for the fitment, said wall having an annular relieved section therein adjacent said inner skirt and opening into the space between said skirts, said relieved section having opposed side walls and a bottom wall, one of said side walls forming an extension of the outer surface of said inner skirt, said bottom wall extending radially outwardly from said engaging portion, an outer surface of said interconnecting wall defining a first wall section with said bottom wall, said annular wall including a second wall section spaced apart from said first wall section and extending inwardly from said outer skirt, said snap bead extending from an outer end of said first wall section, whereby any distortions imposed on said snap bead and on said sealing surface as occasioned by any dimensional and/or shape irregularities in the container neck are reduced by the relief between inner and outer engagements with the container neck thereby resulting in an isolation of any distortions of said skirts relative to one another, an isolation of any outer skirt distortion relative to said snap bead, an isolation of any inner skirt distortion relative to said sealing surface and the maintenance of dimensional stability between said snap bead and said sealing surface.

2. The sealing means according to claim 1, wherein said first wall section defines a circular reinforcement flange for retaining the circularity of said engaging portion at said sealing surface thereof regardless of any of the irregularities in the container neck.

3. The sealing means according to claim 1 or 2, wherein said first and second wall sections are interconnected by a third wall section which contains the other of said side walls of said relieved section, an annular seal bead provided on said third wall section and extending into the space between said skirts, said seal bead being engageable with the terminal end of the container neck for improving upon the seal between said body member and the container.

4. The sealing means according to claim 1 or 2, wherein said first and second wall sections are interconnected by a third wall section which contains the other of said side walls of said relieved section, an annular seal bead provided on said inner skirt and extending into the space between said skirts, said seal bead being engageable with the terminal end of the container neck for improving upon the seal between said body member and the container.

5. The sealing means according to claim 1 or 2, wherein said first and second wall sections are interconnected by a third wall section which contains the other of said side walls of said relieved section, annular seal beads provided on said third wall section and on said inner skirt and extending into the space between said skirts, said seal beads being engageable with the terminal end of the container neck for improving upon the seal between said body member and the container.

6. The sealing means according to claim 1 or 2, wherein an annular seal bead is provided on said inner sealing surface of said engaging portion for improving upon sealing engagement with the fitment.

7. The sealing means according to claim 6, wherein said engaging portion defines a pour spout having an outwardly curved pour lip, said annular bead lying adjacent said lip and having an outer curved surface which blends with the curvature of said lip, the inner surface of said bead being conical, and the junction between said inner and outer surfaces defining an annular mouth edge, whereby said pour spout functions as a dripless spout.

8. The sealing means according to claim 1, wherein said body member includes annular seal means extending into the space between said skirts, said seal means being engageable with the terminal end of the container neck and defining a primary seal between said body member and the container.

9. The sealing means according to claim 8, wherein said outer skirt includes an inwardly extending lock ring engageable with a retention bead provided on the neck of the container, and said outer skirt being spaced apart from said inner skirt a predetermined distance so as to be spaced outwardly from the outer diameter of the retention bead, whereby normal container dimensional tolerances can be accommodated without said outer skirt being bulged out of shape by engagement with the retention bead.

* * * * *